US011483639B2

(12) United States Patent
Park

(10) Patent No.: US 11,483,639 B2
(45) Date of Patent: Oct. 25, 2022

(54) SOUND SENSING SYSTEM

(71) Applicant: NEW YORK UNIVERSITY, New York, NY (US)

(72) Inventor: Tae Hong Park, New York, NY (US)

(73) Assignee: New York University, New York, NY (US)

( * ) Notice: Subject to any disclaimer, the term of this patent is extended or adjusted under 35 U.S.C. 154(b) by 0 days.

(21) Appl. No.: 17/347,087

(22) Filed: Jun. 14, 2021

(65) Prior Publication Data

US 2021/0392421 A1 Dec. 16, 2021

Related U.S. Application Data

(60) Provisional application No. 63/039,889, filed on Jun. 16, 2020.

(51) Int. Cl.
*H04R 1/02* (2006.01)
*G08B 13/16* (2006.01)

(52) U.S. Cl.
CPC ..... *H04R 1/025* (2013.01); *G08B 13/169* (2013.01)

(58) Field of Classification Search
CPC ..... H04R 1/025; G08B 13/169
USPC ..... 381/337
See application file for complete search history.

(56) References Cited

U.S. PATENT DOCUMENTS

2008/0279408 A1* 11/2008 Matsui ..... H04R 1/08 381/363
2009/0252353 A1* 10/2009 Parker ..... H04R 25/00 381/151
2016/0205470 A1* 7/2016 Akino ..... H04R 19/04 381/174

* cited by examiner

*Primary Examiner* — Sean H Nguyen
(74) *Attorney, Agent, or Firm* — Foley & Lardner LLP

(57) ABSTRACT

An outdoor sound sensing system ideal for homes and buildings equipped with windows called the sound sensing system. The sound sensing system consists of a two-sided printed circuit board with a microphone module, a lightweight sticker, and a cable system that connects the printed circuit board to a sound recording and processing module. The printed circuit board has an aperture aligned to an acoustic shield to provide protection from the environment for the microphone module. The lightweight sticker has an aperture that is also aligned to the acoustic shield.

7 Claims, 12 Drawing Sheets

SOUND SENSING SYSTEM

CROSS-REFERENCE TO RELATED APPLICATIONS

The present application claims the benefit of and priority to U.S. Provisional Patent Application No. 63/039,889 filed Jun. 16, 2020, which is incorporated by reference herein in its entirety.

BACKGROUND

Advancements in technology for the common home has drastically changed the way we monitor our surroundings. One manner in which users monitor their home's surroundings is through outdoor sensing devices. Current devices are complex, costly, and suffer from ineffective protection in outdoor environment. Industry standard outdoor sound sensing devices typically consist of a microphone, amplifier, recording system, power supply or battery module, data collection module, data processing unit, and either a wireless or wired data communication module. These modules are typically contained in a water resistant and fire resistant container or box designed to withstand harsh environmental conditions. There are a number of issues with such industry standard systems. The modules may be inside a container, yet still be exposed to an outdoor environment. Installing the containers outdoors securely is complicated, costly, and oftentimes dangerous. Furthermore, the modules inside the container can be costly, sensitive, and prone to damage and theft even for systems with the sturdiest containers. The majority of modules for any long-term sensing situations require a power supply and/or communication lines and in turn, complications in determining wiring setup. If the system is wireless, the module relies on an intermittent battery solution. Regardless of the approach, by being exposed to the environment, maintenance of these systems are difficult and costly. There is a need for a system that is simple, inexpensive, and stable.

SUMMARY

One implementation relates to an exterior window sound sensing system ideal for homes and buildings equipped with windows. The window sound sensing system consists of a printed circuit board with a microphone module, a lightweight sticker, and a cable system that connects the printed circuit board to a sound recording and processing module. The printed circuit board has an aperture aligned to an acoustic shield to provide environmental protection to the microphone module. The lightweight sticker also has an aperture aligned to the acoustic shield.

The foregoing summary is illustrative only and is not intended to be in any way limiting. In addition to the illustrative aspects, embodiments, and features described above, further aspects, embodiments, and features will become apparent by reference to the following drawings and detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several implementations in accordance with the disclosure and are therefore, not to be considered limiting of its scope, the disclosure will be described with additional specificity and detail through use of the accompanying drawings.

DETAILED DESCRIPTION OF VARIOUS EMBODIMENTS

Figure 1:
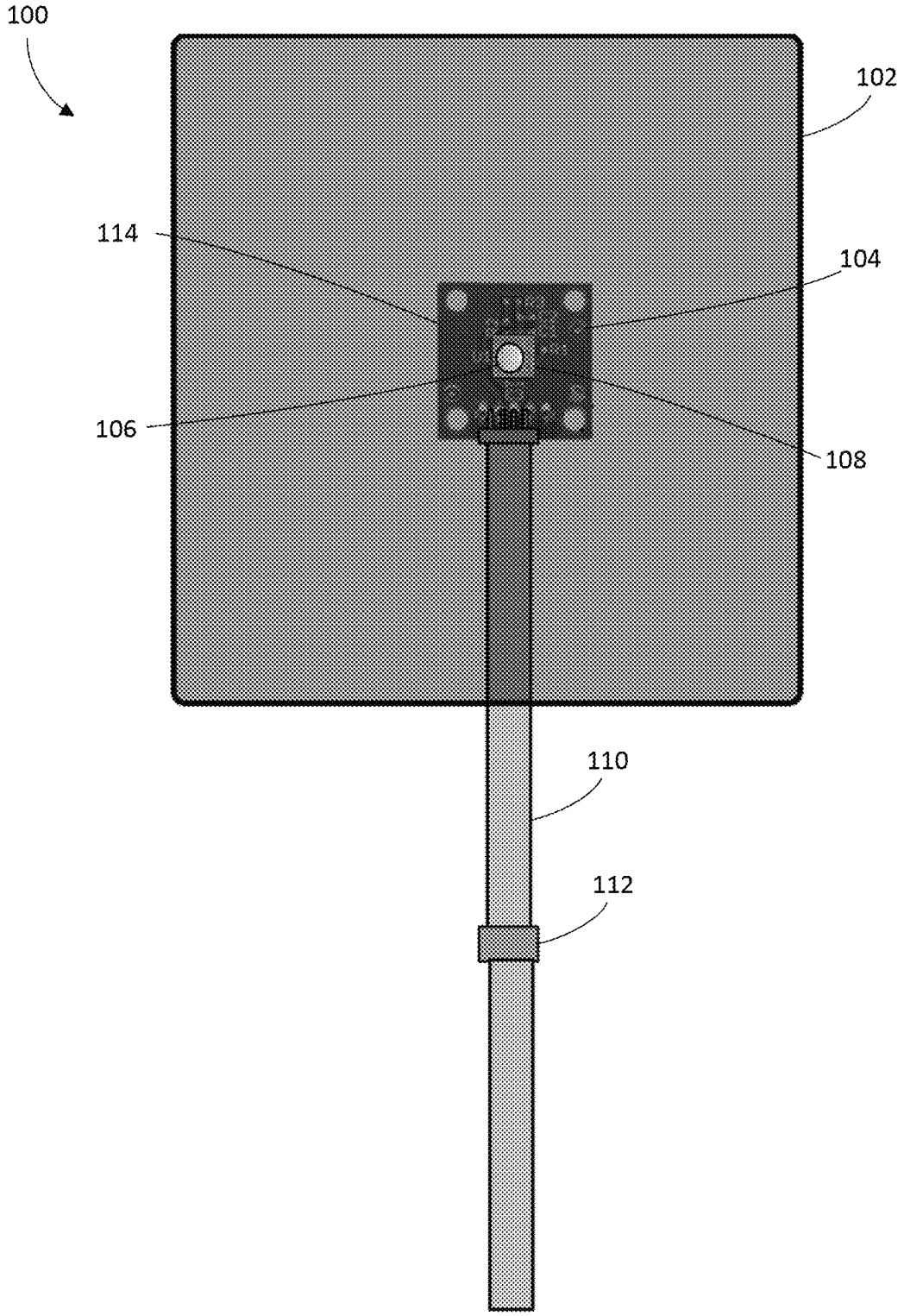
FIG. 1 illustrates one implementation of a sound sensing system.

In the following detailed description, reference is made to the accompanying drawings, which form a part hereof. In the drawings, similar symbols typically identify similar components, unless context dictates otherwise. The illustrative embodiments described in the detail description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

In one implementation, the sound sensing system comprises a window sticker module 100. The window sticker module 100 enables a practical sensor network through one or more sound sensing devices. The window sticker module 100 device can be adhered to any home or commercial building utilizing surfaces such as a window 802.

In one embodiment, the window sticker module 100 comprises a lightweight sticker 102, a microphone module

104, a cable system to connect to the Printed Circuit Board ("PCB") 114, and a sound recording and processing module 804.

The custom microphone module 104 circuitry utilizes a MEMS microphone design that has an unusually low footprint is approximately an area akin to a large stamp and only 3 mm in height. This design allows the window sticker module 100 to be lightweight which is advantageous to the system design. The microphone module 104 MEMS circuitry populates the back side (or surface) of the PCB 114 while the front side (or surface) of the PCB 114 has a microphone hole (or aperture) to allow passing of acoustic signals to the microphone module 104. FIG. 1 shows this architecture in "transparent" view. To make the microphone module 104 water resistant, an acoustic shield 108 covers the acoustic opening on the front. In one embodiment, the acoustic shield 108 (and/or the acoustic vent 402*a*) utilize hydrophobic material and or spaced openings (pores, mesh, slits, etc.) sized to prevent water permeability. As a non-limiting example, the acoustic shield 108 or acoustic vent 402*a* is based on polytetrafluoroethylene ("ePTFE") material technology that consists of large enough mesh material that allows sound to reach the microphone module 104, but small enough to repel water, debris, and oil with IPX4 rating that robustly operates in heavy rain conditions. As the acoustic shield 108 or acoustic vent 402*a* is water repellant, dry off time is for all practical purposes negligible, thus minimizing and change in acoustic frequency response due to rain, for example. This is not the case for traditional microphone systems where water resistant windscreens are used. These types of systems typically need hours to dry. During this drying period, the frequency response characteristics change and thus affects the measurement characteristics of the microphone module 104.

One embodiment of the unique cable system incorporates a flat cable 110 and a flat cable extender 112 as illustrated in FIG. 1.

Figure 2:
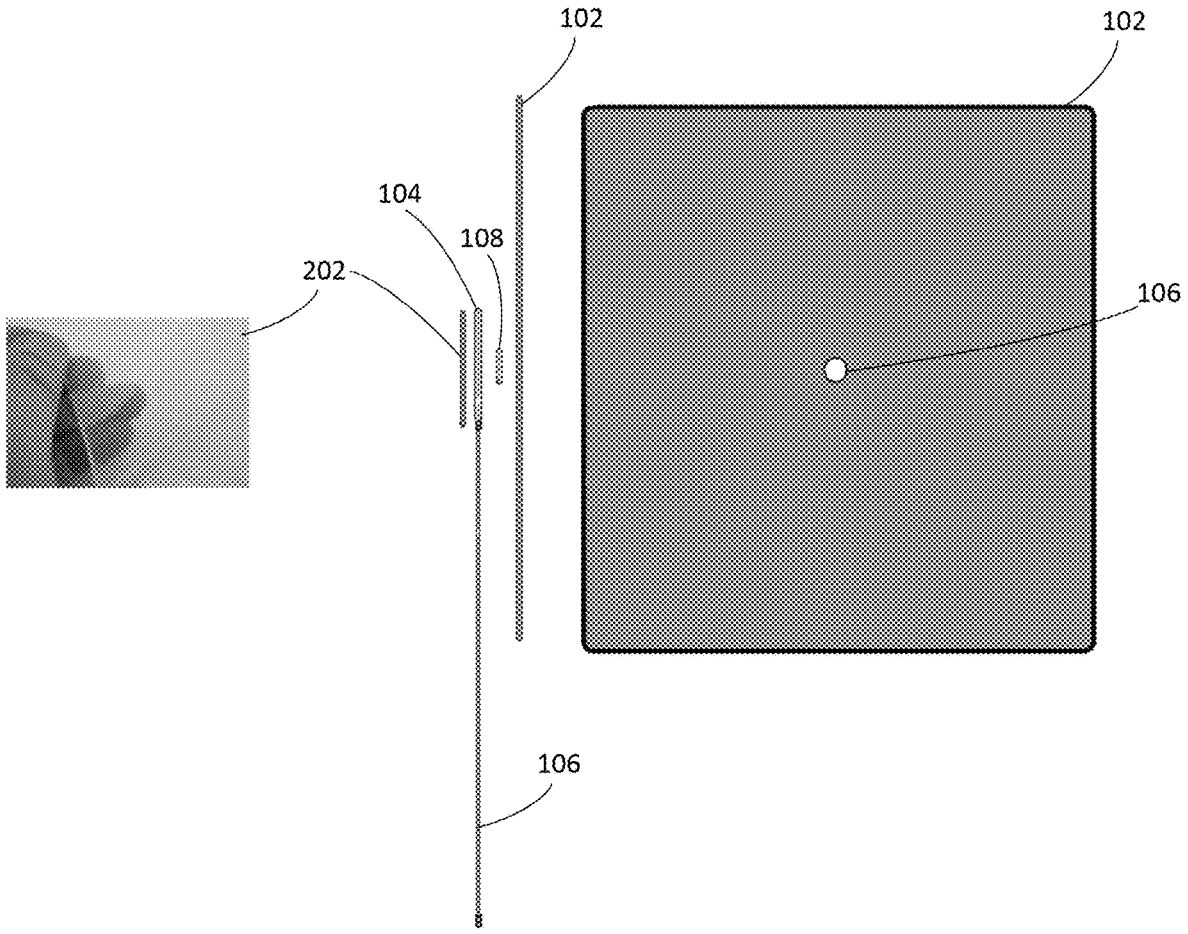
FIG. 2 illustrates a side view implementation of the sound sensing system of FIG. 1.

FIG. 2 shows a side view of an example embodiment of the window sticker module 100. The outermost layer of the lightweight sticker 102 is a waterproof film—e.g. industry grade waterproof adhesive film or sticker—with a microphone opening 106 that is large enough to allow an acoustic shield 108 or acoustic vent 402*a* to be applied behind or on top of the film. The acoustic shield 108 or acoustic vent 402*a* allows sound to reach the microphone module 104 while protecting it from water splashes including heavy rain. The microphone opening 106 is axially in line with the acoustic vent 402*a* or acoustic shield 108. The waterproof film itself serves two purposes: (1) protect the microphone module 104 circuitry from harsh outdoor environments and (2) make possible for the window sticker module 100 to be adhered flatly onto the outside surfaces such as windows. The flat design addresses stability, facilitates installation, and solves the issue of birds and other animals, insects, as well as general debris to get attracted to the sensor as is typically experienced with traditional outdoor sensors. In the illustrated embodiment of FIG. 2, the window sticker module 100 includes a sound dampening layer 202, such as positioned proximate to the surface to which the window sticker module is adhered, such as proximate the window, that protects the microphone module 104 exposed towards the window 802 and simultaneously dampens vibrations that may be picked up by the window surface.

In another implementation of the sound sensing system incorporates a larger sized PCB 302. The microphone module 104 circuit for the larger sized PCB 302 is the size of a credit card with a cable insert pathway 304 as shown in FIG. 3.

Figure 4:
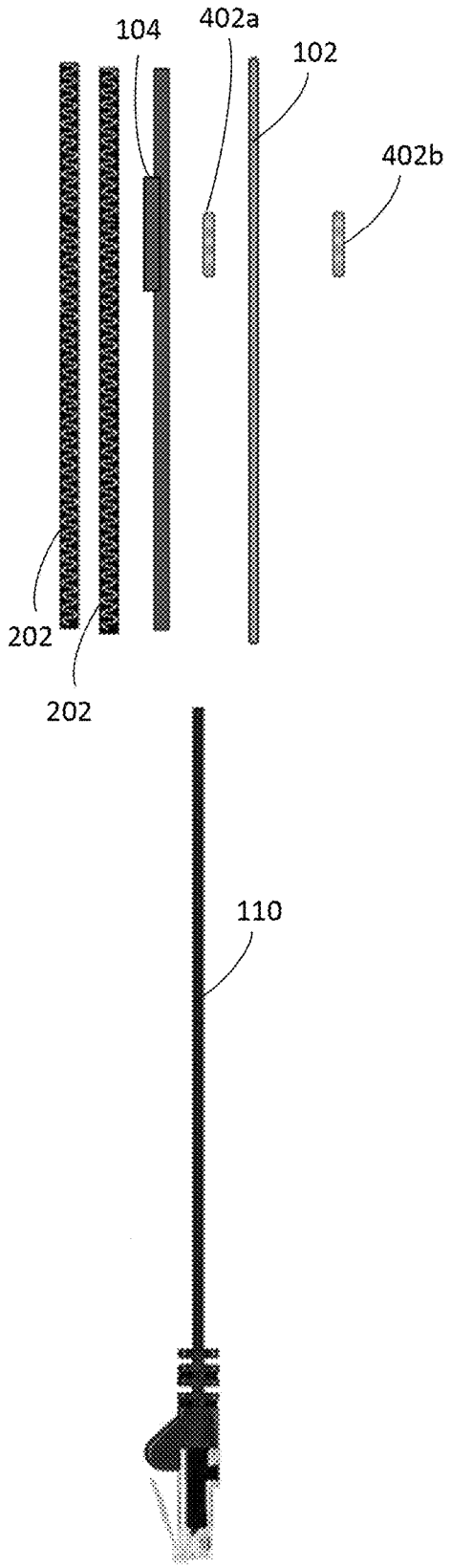
FIG. 4 illustrates a side view implementation of the sound sensing system with a larger sized PCB.

FIG. 4 illustrates a side view of the implementation of the sound sensing system incorporates a larger sized PCB 302

Figure 3:
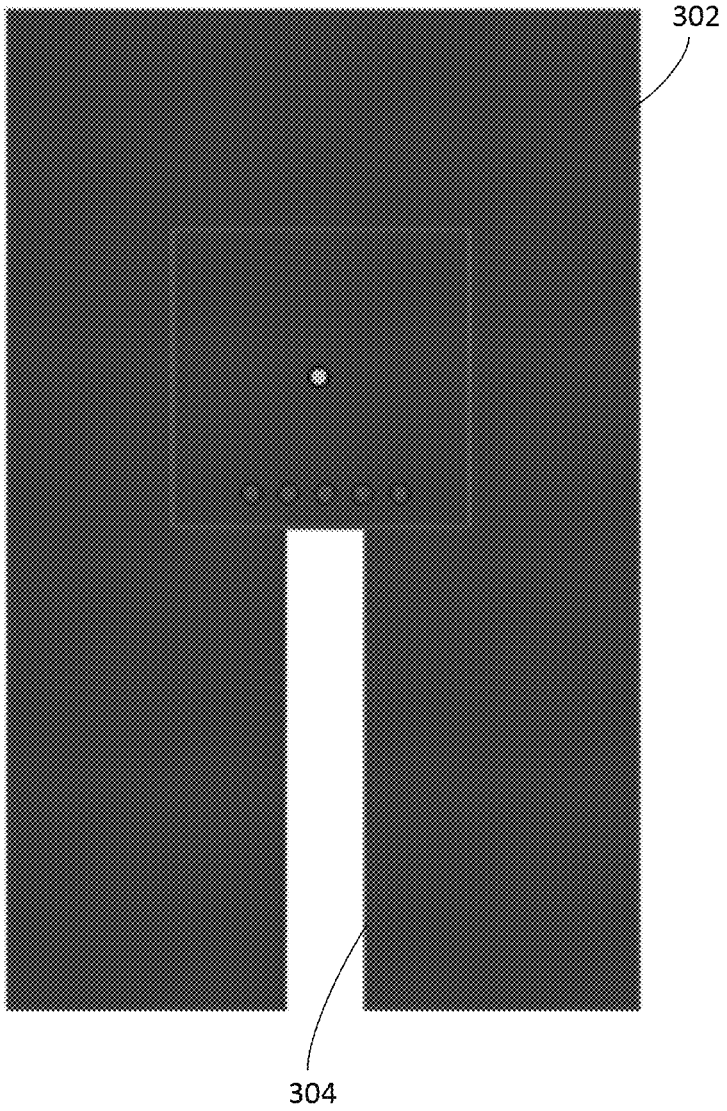
FIG. 3 illustrates another implementation of a sound sensing system with a larger sized PCB.
Figure 5:
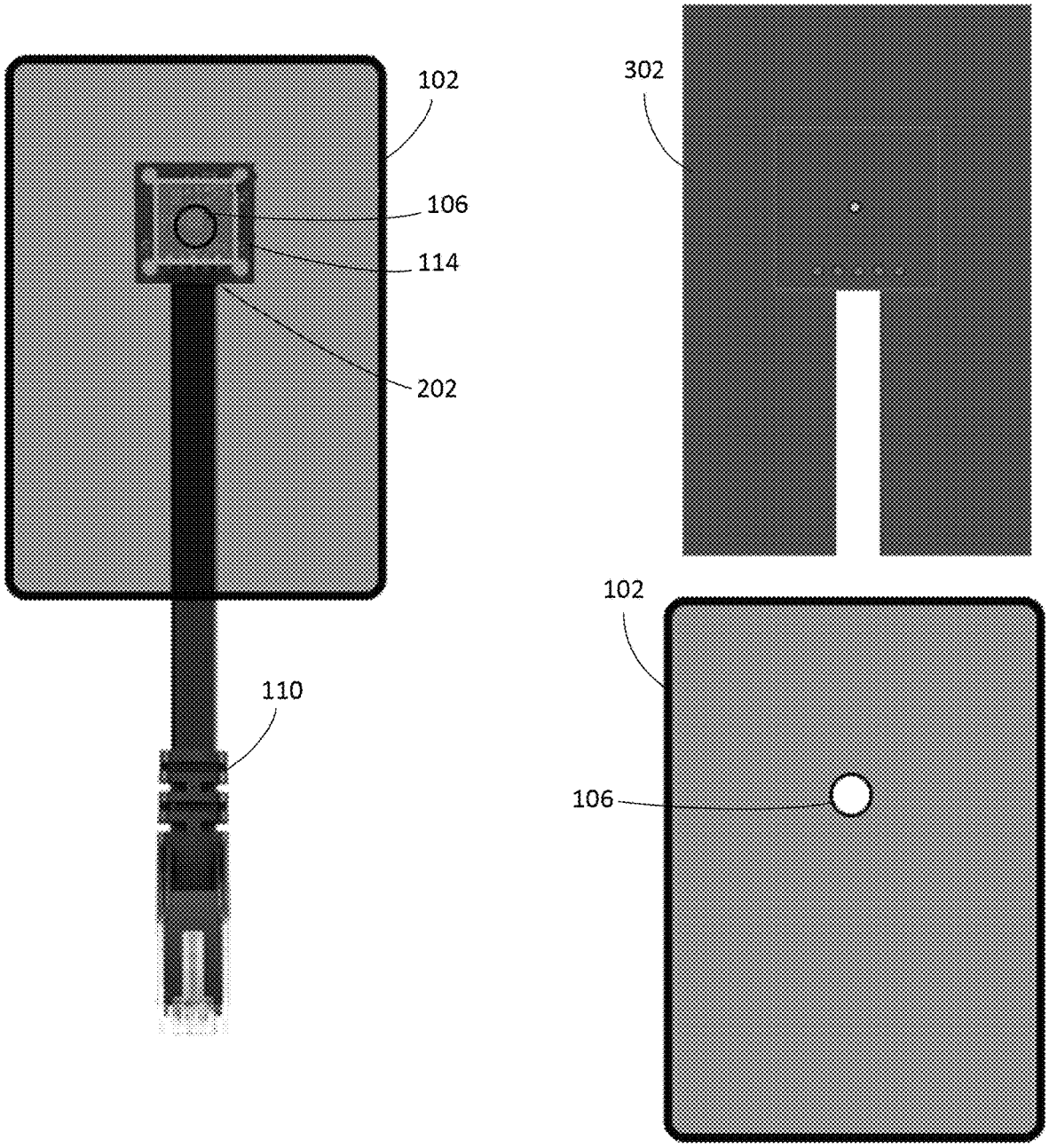
FIG. 5 illustrates a comparison of an implementation of FIG. 1 and an implementation of FIG. 3.

FIG. 5 shows a comparison of the window sticker module 100 of FIG. 1 and the implementation using a larger sized PCB 302 of FIG. 3

Similar to the first exemplary PCB 114 described in FIG. 1, the larger sized PCB 302 implementation also includes (1) a lightweight sticker 102 at the outermost layer protecting the microphone module 104, (2) a microphone opening 106 to allow sound to reach the microphone module 104, and (3) an acoustic vent 402*a* to protect the microphone module 104 from environmental conditions such as rain and snow. A concave shield 402*b* is further installed to additionally protect the mic section from debris that may reach during windy days, for example. The backside of the larger sized PCB 302, which has the exposed circuitry, includes a sound dampening layer 202 to absorb mounting surface vibration. Additionally, it includes an adhesive final layer (e.g. Velcro) to allow (1) flexible attachment and re-attachment to a new position an ease of replacement and (2) further mounting surface dampening for additional vibration attenuation inadvertently caused by mounting surface vibration (e.g. window).

Figure 6:
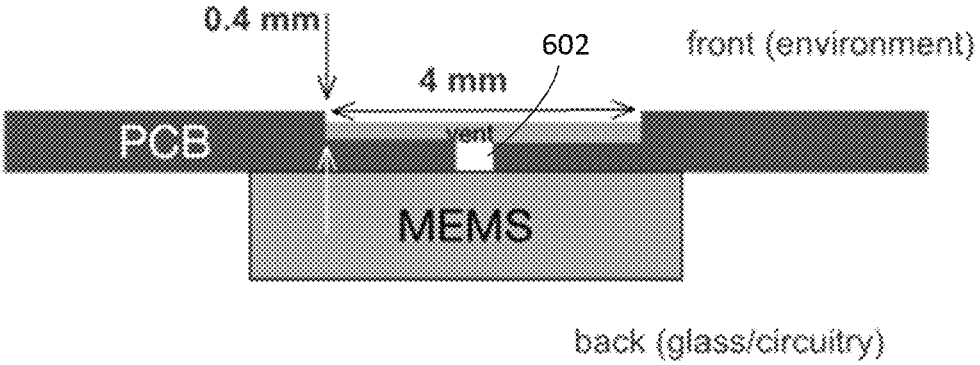
FIG. 6 illustrates an implementation of a printed circuit board with a front vent indentation.

In another implementation as shown in FIG. 6, the PCB 114 includes a 4 mm by 0.4 mm front vent indentation 602 where the acoustic vent 402*a* can be securely attached in front of the microphone module 104 circuitry and from outdoor facing part of the PCB 114.

Figure 7:
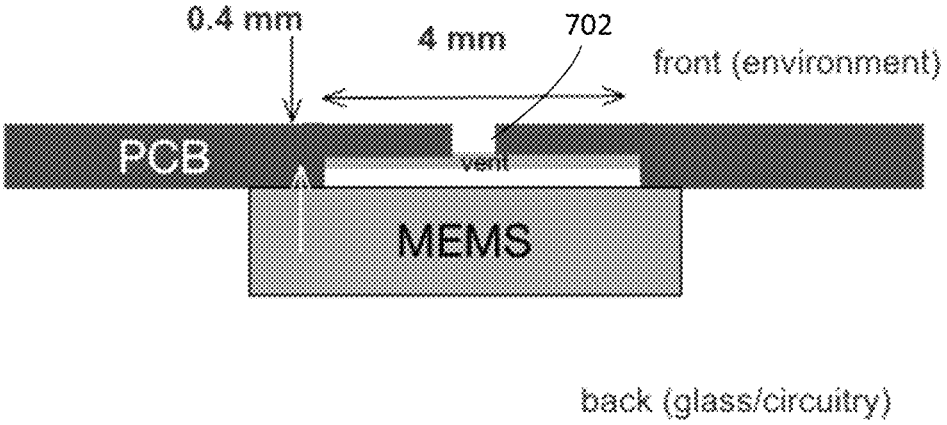
FIG. 7 illustrates an implementation of a printed circuit board with a back end indentation.

In another implementation as shown in FIG. 7 the PCB 114 includes a 4 mm by 0.4 mm back vent indentation 702 behind the acoustic opening where the vent can be securely attached in front of the MEMS microphone circuitry and from behind the PCB 114 facing indoors. This design additionally allows further protection of the acoustic vent 402*a* adhesive ring that attaches the acoustic vent 402*a* to the PCB 114 as it is not exposed to outdoor conditions.

In another implementation, the PCB contains the MEMS circuitry as part of the PCB itself to reduce even further the height of sensor system where the back side of the PCB does not have a protruding circuit module but rather, the circuitry is embedded as part of the PCB rendering flush back and front PCB sides.

Figure 8:
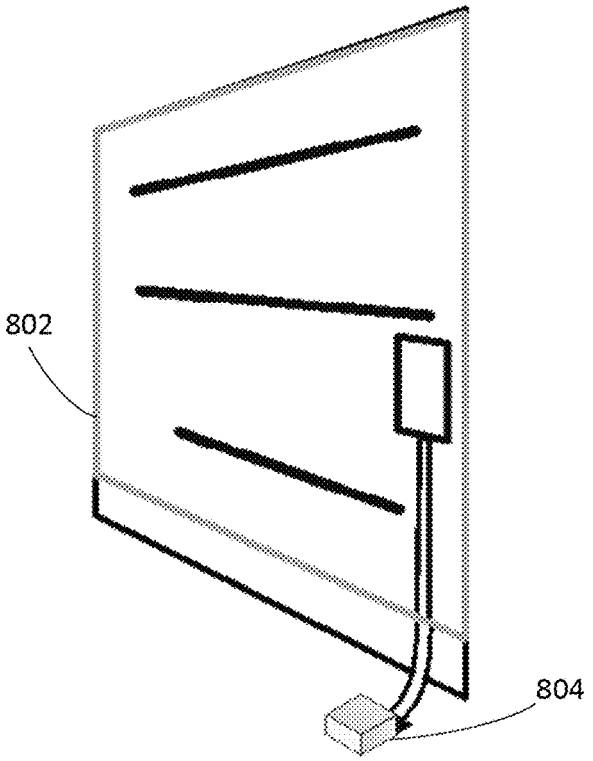
FIG. 8 illustrates a window sticker and microphone located outdoors, while a processing unit is located indoors, and flat cable connecting both modules.

In one embodiment, a flat cable 110 connects the microphone module 104 to the sound recording and processing module 804 protected indoors. As shown in FIG. 8 a flat cable 110 passes through the window sill 1204 and window rail 1202, where the window 802 is closed, and microphone module 104 is provided with power and data connection while the sound recording and processing module 804 is safely stored indoors.

Figure 9:
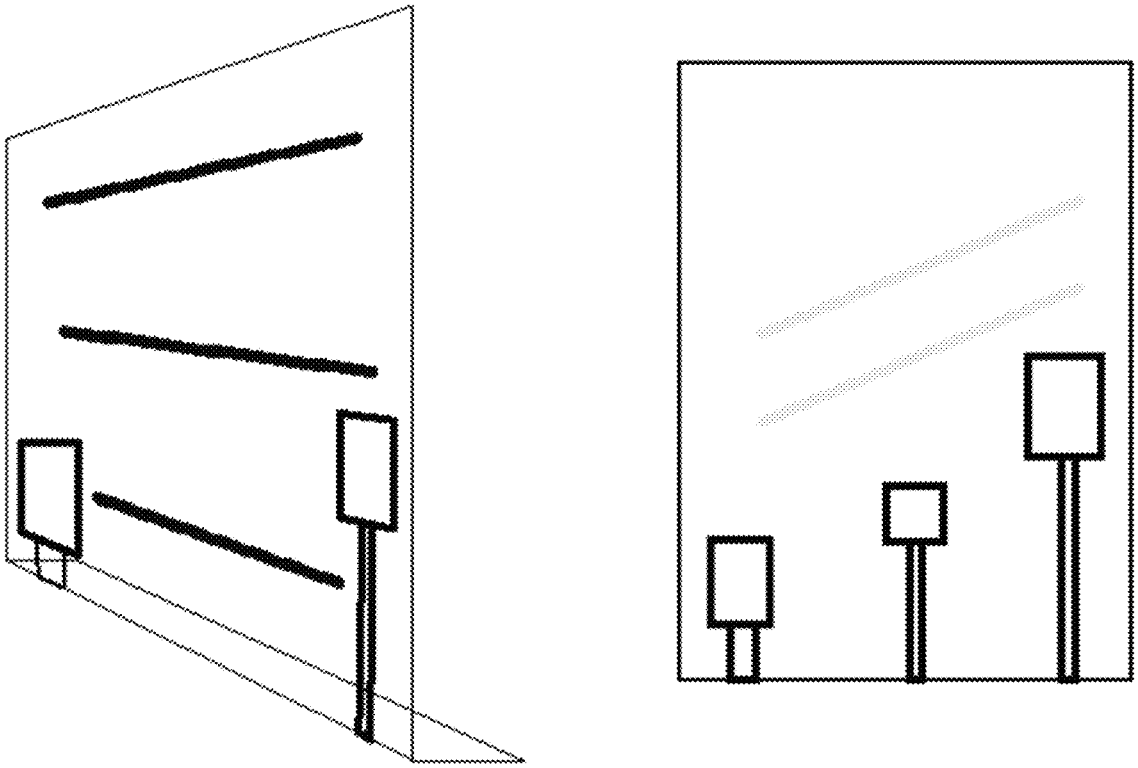
FIG. 9 illustrates various installations of a sound sensing system.
Figure 10:
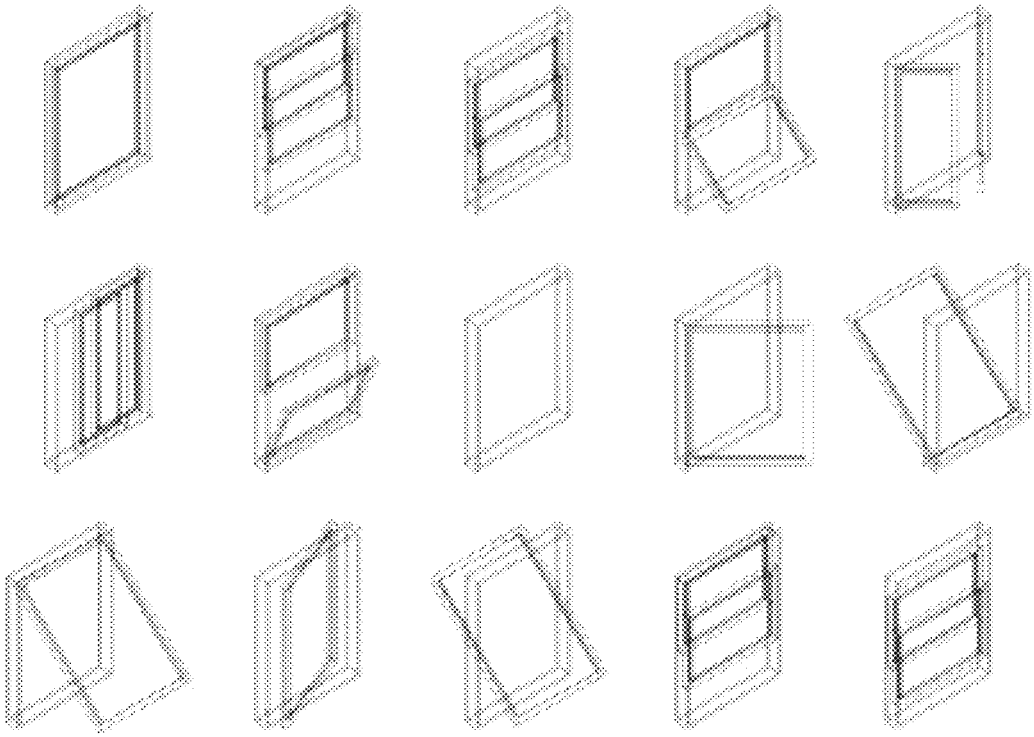
FIG. 10 illustrates example window types.

FIG. 9 shows additional window sticker module 100 installation configurations. The window sticker module 100 can be installed in most of the common window 802 designs including as shown in FIG. 10.

Figure 11:
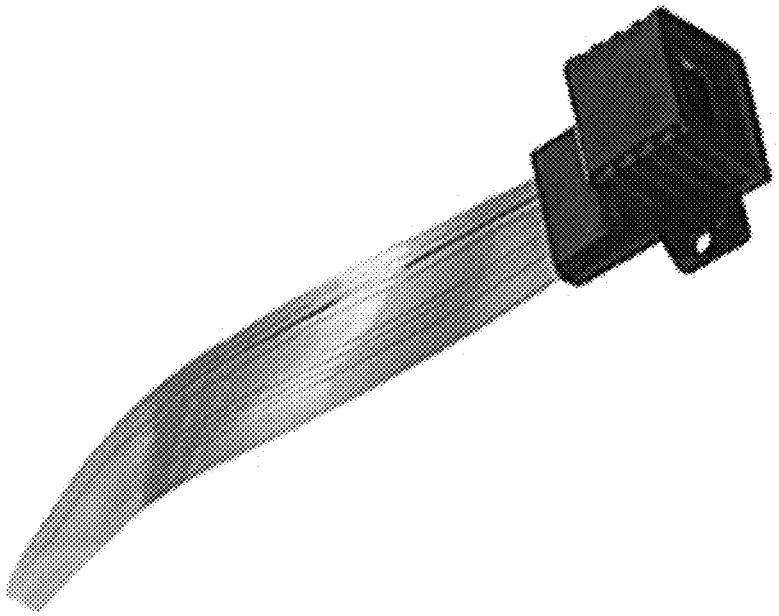
FIG. 11 illustrates an example flat cable.

An example flat cable 110 is shown in FIG. 11 where in an exemplary implementation there are three lines—one for ground, one for power supply, and one for signal from the microphone module 104 to the sound recording and processing module 804. To improve noise interference of the cable and microphone module 104, the exemplary implementation includes a ferrite at one end of the cable and a passive low pass filter at the power supply pin of the sound recording and processing module 804.

Figure 13:
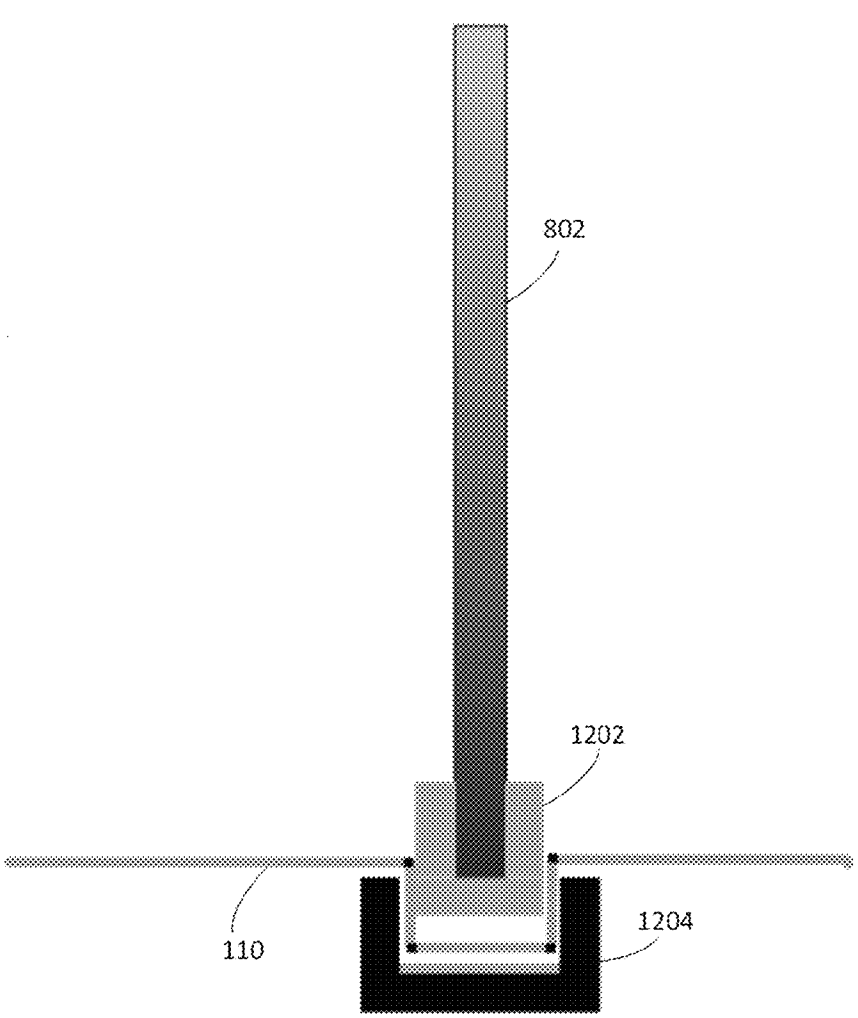
FIG. 13 illustrates an example cable length to offset the sill/rail window closing mechanism as denoted by the four dots.
Figure 12:
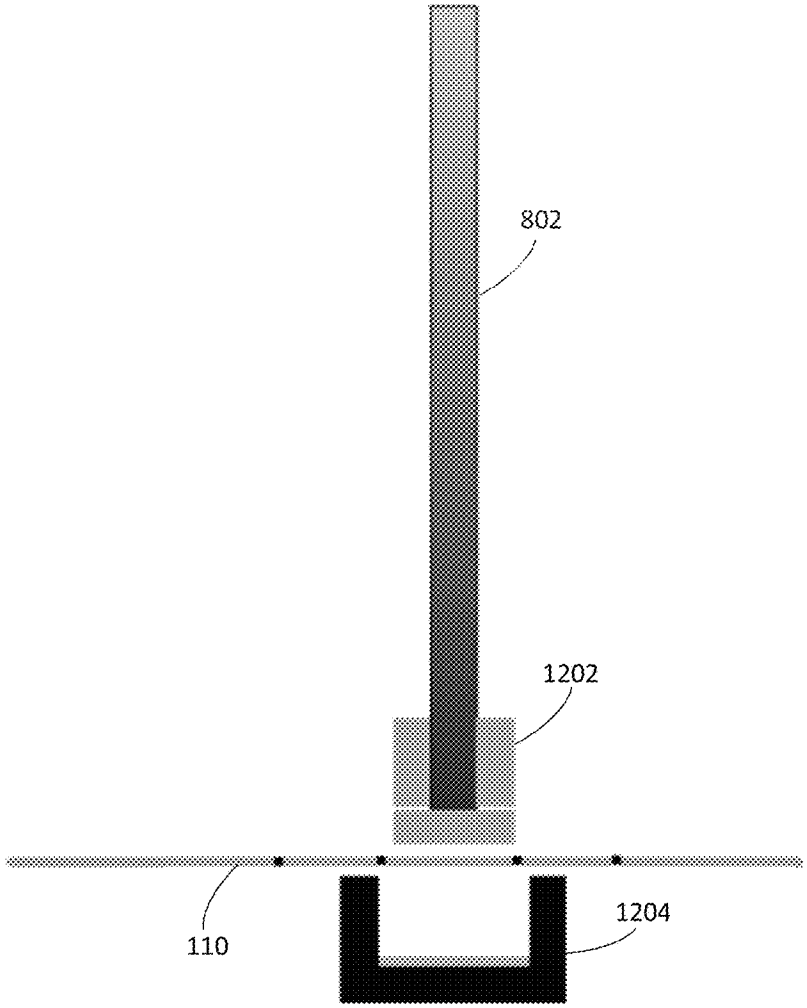
FIG. 12 is an example situation in which cables may be damaged when opening and closing the window to which the sound sensing system is attached.
Figure 14:
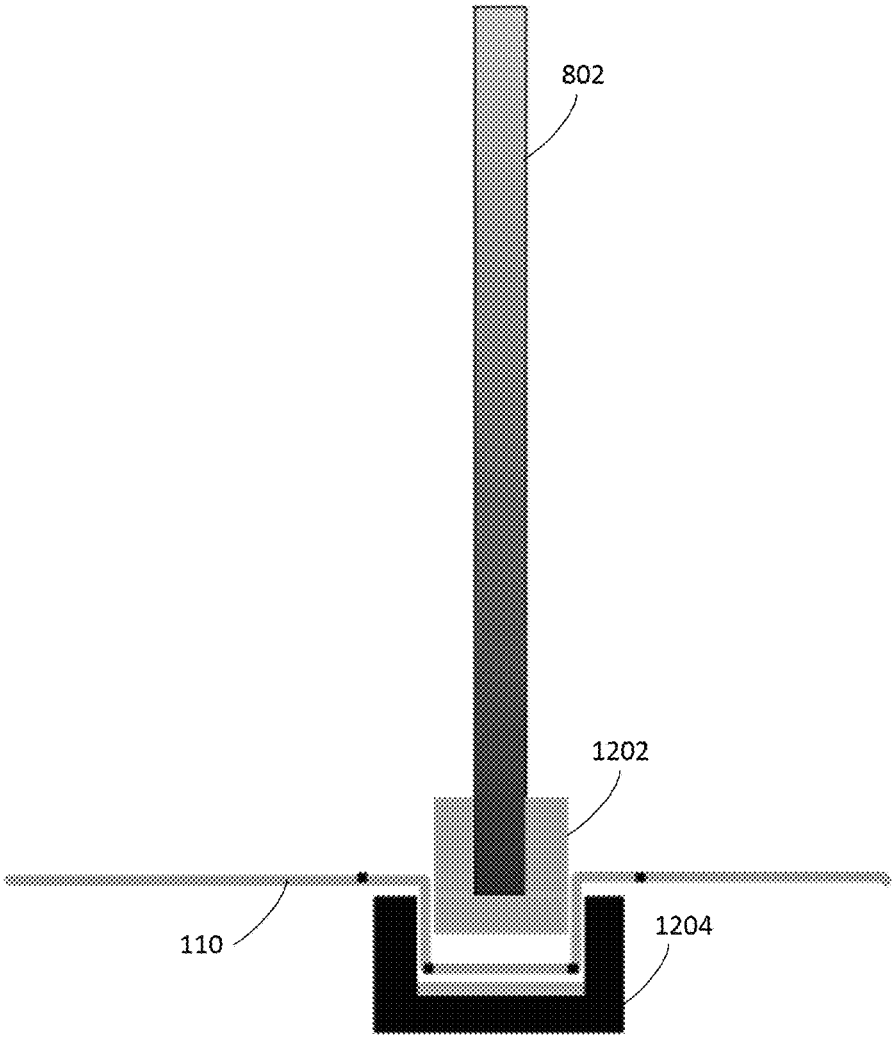
FIG. 14 illustrates a cable length being stretched when closing the window as the cable is unable to slide to increase its length without stretching as denoted by the two flanking outer dots.

While a sturdy flat cable 110 makes connection between the microphone module 104 and the sound recording and processing module 804 robust, experimentation has shown situations where cables are damaged when opening and closing the window 802 to which a window sticker module 100 is attached. This is shown in FIG. 12 before the window 802 is closed; in FIG. 13 when window 802 is closed and flat cable 110 is properly adjusted to offset the extra cable need when closing in proportion to the window sill depth; and in FIG. 14 where the window sill 1204 and window rail 1202 cause damage to the flat cable 110 when closing a window 802. In such situations, the flat cable 110 may stretch, chip, and cut and in severe cases, completely break the flat cable 110.

Figure 15:
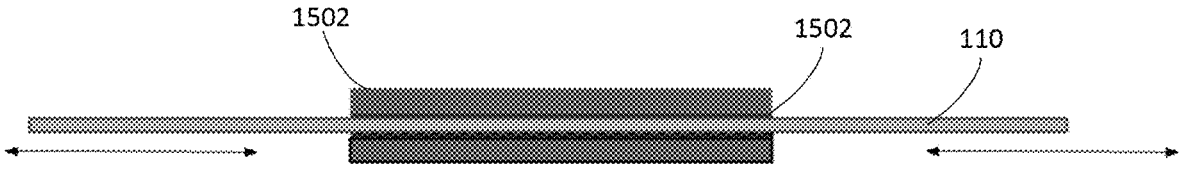
FIG. 15 illustrates a cable projection module.

To address cable instability problem, a cable protection module 1502 is implemented as shown in FIG. 15 enabling the cable to freely move within the protection module which in turn, minimizes cable stress, as extra cable length is smoothly slid into the sill/rail area proportional to the window sill 1204 depth.

Figure 16:
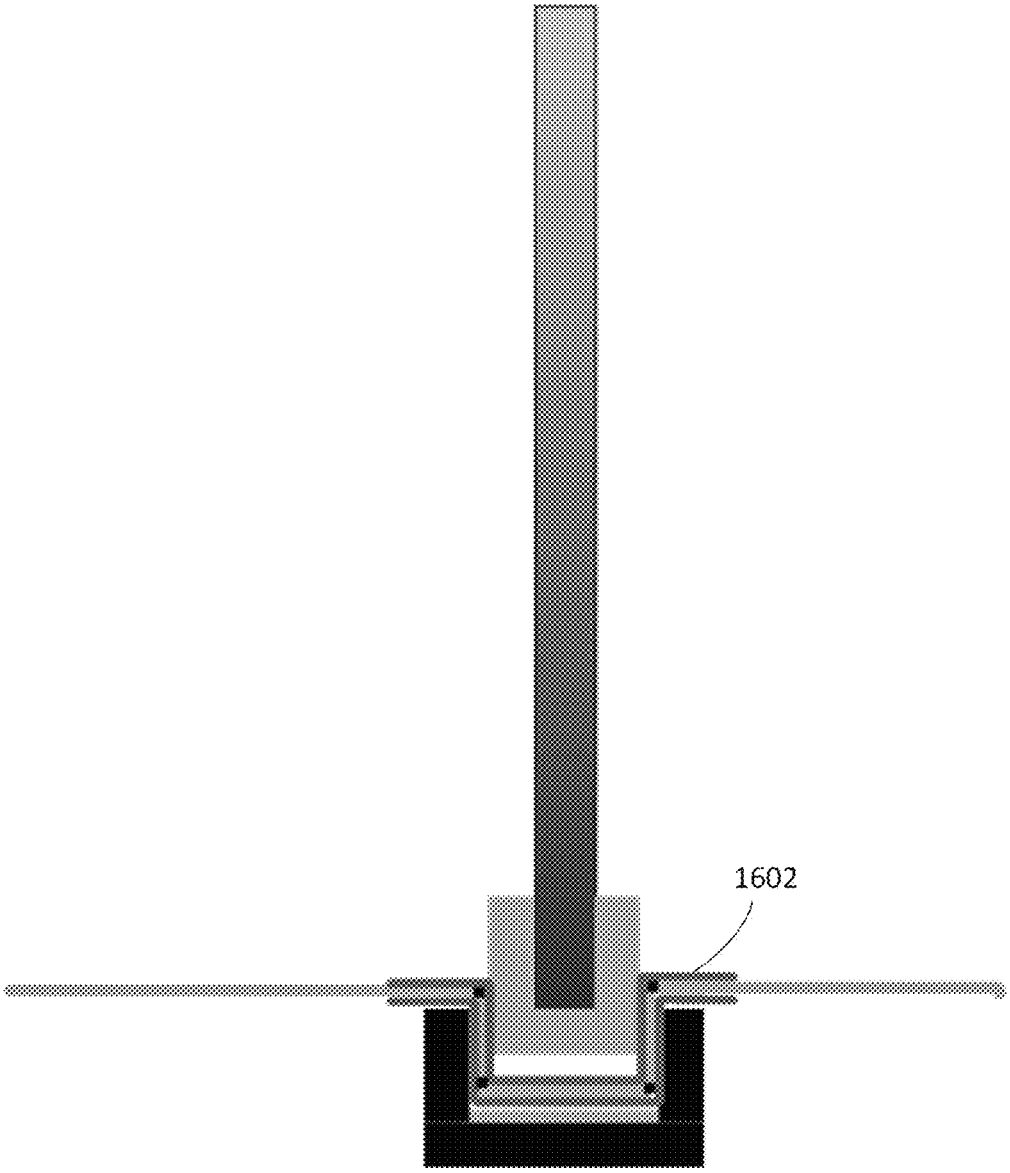
FIG. 16 illustrates a cable to enable sliding of the cable to offset sill/rail mechanism.

The cable protection module 1502 completely covers the cable and is made of flexible materials similar to industrial grade Velcro. While the outer material covering the cable protects the cable, the inner material of the cable protection module has a brushed inner layer 1504 that allows the cable to move freely and adjust its length. This is further shown in FIG. 16 where no stretching occurs—i.e. dots are positioned at each corner of the cable and window rail locations. FIG. 16 further illustrates no stretching through the flexible cable glove 1602.

Figure 17:
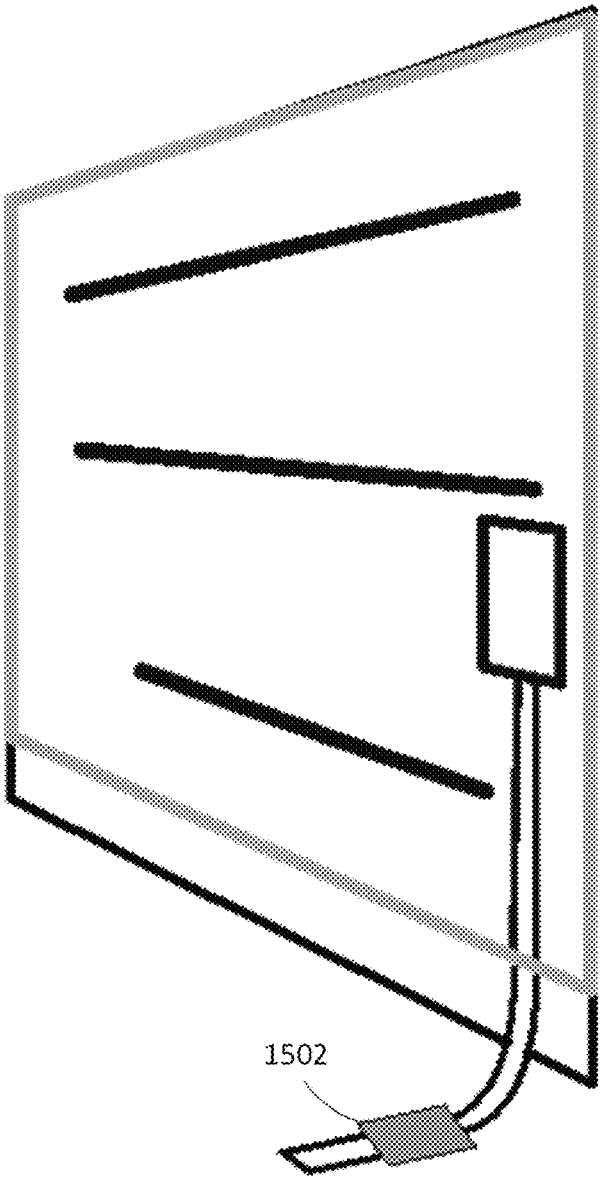
FIG. 17 illustrates the sound sensing system with a cable protection module.

FIG. 17 shows the window sticker microphone system along with an exemplary cable protection module 1502.

Various embodiments are described in the general context of method steps, which may be implemented in one embodiment by a program product including computer-executable instructions, such as program code, executed by computers in networked environments. Generally, program modules include routines, programs, objects, components, data structures, etc. that perform particular tasks or implement particular abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps.

Software and web implementations of the present invention could be accomplished with standard programming techniques with rule based logic and other logic to accomplish the various database searching steps, correlation steps, comparison steps and decision steps. It should also be noted that the words "component" and "module," as used herein and in the claims, are intended to encompass implementations using one or more lines of software code, and/or hardware implementations, and/or equipment for receiving manual inputs.

As used herein, the singular forms "a", "an" and "the" include plural referents unless the context clearly dictates otherwise. Thus, for example, the term "a member" is intended to mean a single member or a combination of members, "a material" is intended to mean one or more materials, or a combination thereof.

As used herein, the terms "about" and "approximately" generally mean plus or minus 10% of the stated value. For example, about 0.5 would include 0.45 and 0.55, about 10 would include 9 to 11, about 1000 would include 900 to 1100.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Other substitutions, modifications, changes and omissions may also be made in the design, operating conditions and arrangement of the various exemplary embodiments without departing from the scope of the present invention.

While this specification contains many specific implementation details, these should not be construed as limitations on the scope of any inventions or of what may be claimed, but rather as descriptions of features specific to particular implementations of particular inventions. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed:

1. A sound sensing system comprising:

a printed circuit board having a first surface and a second surface, the first surface defining a first aperture and a shield disposed axial to the first aperture, the second surface comprising a cable connector and a microphone disposed axial to the first aperture;

a recording device;

a cable having a first end coupled to the cable connector and a second end, coupled to the recording device; and an adhesive sticker having a second aperture that is disposed axial to the shield.

2. The sound sensing system of claim 1, wherein the shield is comprised of polytetrafluoroethylene configured to repel water, debris, and oil away from the sound sensing system.

3. The sound sensing system of claim 1, wherein the printed circuit board comprises a third aperture, the third aperture comprising:

a first side;

a second side, the second side being contiguous to the first side and the second side being substantially perpendicular to the first side; and a third side, the third side being contiguous to the second side and being substantially perpendicular to the second side.

4. The sound sensing system of claim 1, further comprising an adhesive layer disposed to the second surface.

5. The sound sensing system of claim 4, further comprising an acoustic dampener, the acoustic dampener disposed between the second surface and the adhesive layer.

6. The sound sensing system of claim 1, wherein the first side further comprises an indentation disposed axial to the first aperture configured to be coupled to the shield.

7. The sound sensing system of claim 1, wherein the second side further comprises an indentation disposed axial to the first aperture configured to be coupled to the microphone.

* * * * *